United States Patent [19]

Nash

[11] 4,183,150

[45] Jan. 15, 1980

[54] ELECTRIC CLOTHES DRYER HEATER

[76] Inventor: Robert B. Nash, 4 Mays Ave., Hornell, N.Y. 14843

[21] Appl. No.: 734,402

[22] Filed: Oct. 21, 1976

[51] Int. Cl.[2] ..... F26B 21/06

[52] U.S. Cl. ..... 34/86; 34/235; 34/82; 55/319; 55/320; 55/334; 55/379

[58] Field of Search ..... 34/86, 82, 90, 99, 235; 165/DIG. 2; 55/319, 320, 334, 379

[56] References Cited

U.S. PATENT DOCUMENTS

| | | | |
|---|---|---|---|
| 995,974 | 6/1911 | Lewis | 55/379 |
| 1,979,873 | 11/1934 | Engstrom | 55/334 |
| 2,481,407 | 9/1949 | Fluegel | 34/82 |
| 2,627,669 | 2/1953 | Candor | 34/90 |
| 2,995,204 | 8/1961 | Prostshakov | 55/320 |
| 3,417,481 | 12/1968 | Rumsey, Jr. | 34/90 |
| 3,487,624 | 1/1970 | Tignanelli | 34/82 |
| 3,716,925 | 2/1973 | Hartung | 34/86 |
| 3,744,149 | 7/1973 | Helbling | 34/95 |
| 3,874,857 | 4/1975 | Hunt et al. | 55/379 |
| 3,999,304 | 12/1976 | Doty | 34/86 |
| 4,011,662 | 3/1977 | Davis et al. | 34/86 |

FOREIGN PATENT DOCUMENTS

| | | | |
|---|---|---|---|
| 135278 | 10/1902 | Fed. Rep. of Germany | 55/319 |

*Primary Examiner*—James C. Yeung

[57] ABSTRACT

An apparatus for utilizing the heat and humidity from an electric clothes dryer to heat and humidify an enclosure consists of a container having two openings, one entrance opening communicating with one end of a flexible conduit, the other end of the flexible conduit being capable of attaching to the exhaust outlet of an electric clothes dryer, the second exit opening, having a filter attached thereto, communicating with the enclosure atmosphere.

3 Claims, 3 Drawing Figures

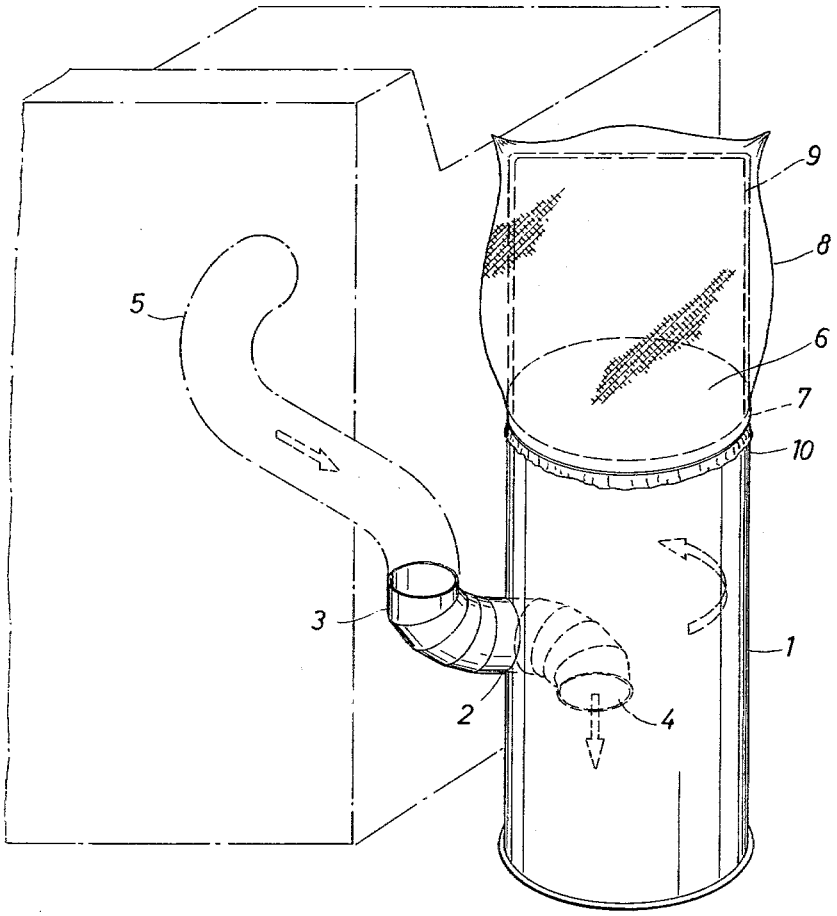
FIG. 1
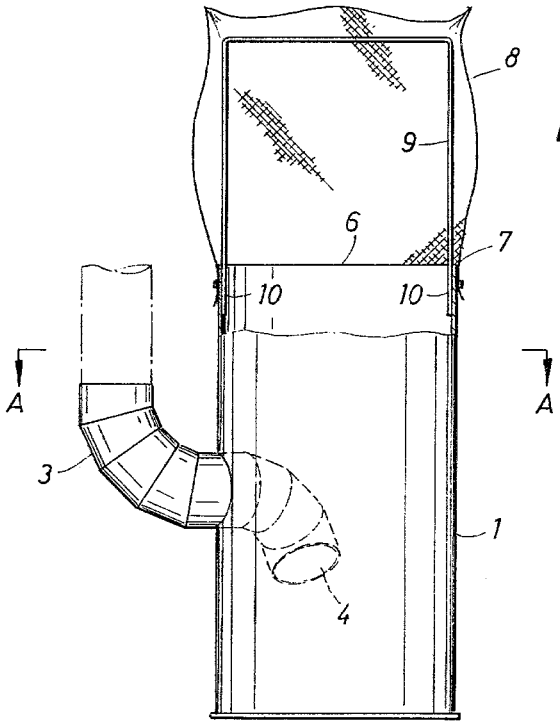
FIG. 2
FIG. 3
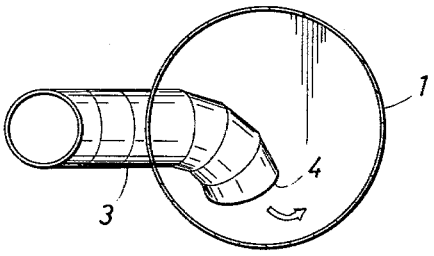

ELECTRIC CLOTHES DRYER HEATER

BACKGROUND OF THE INVENTION

The invention relates to an apparatus for utilizing the heat and humidity generated by an electric clothes dryer to heat and humidify an enclosure or room.

The modern electric clothes dryer produces a substantial amount of heat and water vapor in the process of drying clothes. The conventional dryer is installed so that the exhaust gases are passed to the exterior of the building thus losing this energy and humidity to the surrounding atmosphere.

Under certain conditions, it would be desirable to use the heat and humidity generated by the dryer to heat and humidify the inside atmosphere of a dwelling. This is especially true in the cold, dry portions of the United States.

The present invention is an apparatus for heating and humidifying the inside atmosphere of a dwelling by making use of the exhaust gases of a clothes dryer.

SUMMARY OF THE INVENTION

An apparatus for utilizing the heat and humidity of an electric clothes dryer comprises a container having an entrance opening and an exit opening, the entrance opening communicating with one end of a conduit, the other end of the conduit being capable of attaching to the exhaust outlet of an electric clothes dryer, the exit opening communicating with the atmosphere and having a filter across the exit opening.

BRIEF DESCRIPTION OF THE DRAWING

In the drawing:

FIG. 1 is an elevation illustrating an apparatus having an entrance conduit which enters into the exterior container and an exit opening attached to a porous cover.

FIG. 2 is a plan view of the FIG. 1 apparatus.

FIG. 3 is an elevation view of the apparatus of FIG. 2 cut along plane AA.

DESCRIPTION OF THE PREFERRED EMBODIMENTS

The invention relates to an apparatus for using the heat and humidity of an electric clothes dryer to heat and humidify a portion of a building or enclosure.

The apparatus is made up of a container having a capacity or volume of between about 1 cubic foot and about 5 cubic feet, preferably between about 1 cubic foot and about 3 cubic feet, most preferably between about 1.2 cubic feet and about 1.8 cubic feet. The container must withstand the heat and water vapor from the clothes dryer; therefore, it must be made of a material which will withstand temperature of approximately 150° F., preferably 160° F. and most preferably 180° F. Suitable materials are metals such as iron, steel or tin. These metals are especially suitable when they have been galvanized. Certain flame resistant plastics can also be used such as polyester or epoxy or nylon or polypropylene or ABS. The preferred material is 24 gauge galvanized steel.

The container has two openings, an entrance opening and an exit opening. These two openings are preferably positioned on the container so that gases entering the entrance opening would not flow directly to the exit opening, but would first travel in a random or circular motion within the container. A preferred configuration is to have the entrance opening at one side or near the bottom and the exit opening on the top of the container.

The entrance opening is between about 8 square inches and about 20 square inches, preferably between about 10 square inches and about 15 square inches, most preferably between about 11 square inches and about 13 square inches in area. The exit opening is between about 20 square inches and about 125 square inches, preferably between about 75 square inches and about 125 square inches, most preferably between about 100 square inches and about 115 square inches.

The container can be any shape. A preferred shape for the container is a cylinder, such as a cylinder which is 24 inches tall and 12 inches in diameter.

The container can be set on or equipped with means for supporting the container on the floor such as a stand or one or more legs. This means for supporting the container is preferably made of insulating material such as wood, ceramics, plastics or resins.

The container is connectable to the exhaust outlet of a clothes dryer by means for conducting the hot air and water vapor from the dryer to and into the entrance opening of the container. The entrance conducting means or conduit may be a hollow pipe or tube between about 3 feet to about 12 feet, preferably between about 4 and about 10 feet long and most preferably between about 5 and about 8 feet long. The cross sectional area of the conducting means is between about 8 and about 20 square inches, preferably between about 10 and about 15 square inches and most preferably between about 11 and about 13 square inches. The end of the tube or entrance conduit which is attachable to the clothes dryer is provided with means for connecting it to the exhaust exit of the dryer and fastens it to the dryer. This can be a resilient end which fits snuggly over the clothes dryer exhaust or a clamp means to fix the conducting means so that all of the gases are conducted through the conduit into the container. The end of the entrance conducting means which communicates with the container should be sealingly or securely attached over the entrance opening so that all of the exhaust gas passes into the container. It can be attached to a flange which surrounds the entrance opening or be welded to the area surrounding the entrance opening. In one preferred embodiment of the invention the entrance conduit is attached to the entrance opening and continues on into the interior of the container turning so that the exit opening of the entrance conduit directs the flow of the gases toward the bottom of the container or away from the exit opening of the container.

The entrance conduit must be made of material which can withstand the temperature and moisture of the exhaust gases. It is preferred that the conducting means be flexible. Suitable materials are metals such as iron, tin or steel, especially the galvanized metals, or flame resistant plastics such as nylon, polypropylene, or the like. Other suitable materials are composites of materials such as cloth, metal and plastic composites. The preferred material is flexible 24" gauge galvanized steel sectional or accordian tubing.

In one embodiment the conduit is surrounded by an insulating material to prevent heat losses along its length and to protect persons from coming in contact with the hot surface.

In the invention the exit opening of the container is equipped with a filtering means to catch substantially all, for example, greater than 70 weight percent, preferably greater than 90 weight percent and most preferably greater than 95 weight percent of solids (lint) carried by the exhaust gases. The filter covers the exit opening of the container and is attached or secured thereto. The means for attaching the filter can be a clamp which fits around the container exit opening which may be equipped with a lip or flange to help secure the filter. The attaching means can also be a series of hooks surrounding the container exit opening which hook the edges of the filter or a simple drawstring.

The material from which the filter is made is one which is porous having holes of a size that will catch lint existing with the exhaust gases but will pass the air and water vapor. Preferred filters are woven and nonwoven cloths and screens. Preferred materials from which the cloths or screens that form the filter can be made are natural and manmade organic fibers, glass fibers, metal fibers and mixtures thereof. A preferred filter is a cotton filter bag about 12 inches high and about 12 inches in diameter.

The filter size and porosity must be such that the back pressure caused by the exhaust gases passing through the filter does not excessively overload the dryer blower thereby prematurely burning it out.

The filter is preferably supported by a support means, usually a wire forming a semi-circle or loop over the exit opening of the container and attached thereto, but it could be a plurality of wires or a basket type support. In a preferred embodiment the largest diameter of the loop is larger than the diameter of the container exit opening. The wire or basket is made of a material that can withstand the heat and humidity of the exhaust gases similar to the materials used for the container and the conduit.

The invention is further illustrated by the accompanying figures which are particularized as follows: FIGS. 1, 2 and 3 are views of an embodiment of the invention where 1 is the continer and 2 is the entrance opening. The entrance conduit 3 communicates with the entrance opening 2 and is attached thereto and continues into the interior of the container, the conduit exit opening 4 being directed downward at the bottom of the container. The entrance opening of the entrance conduit 5 is equipped to securely attach to the exhaust exit of an electric clothes dryer. The container 1 has an exit opening 6 with a flange or lip 7 and said exit opening 6 is covered with a filter 8 which is supported by a wire support 9 which is attached to the container 1 at point 10.

Exhaust hot air and water vapor enter the entrance conduit 3 and are passed to the container 1 and out into the atmosphere through the filter 8.

We claim as our invention:

1. An apparatus for heating and humidifying an enclosed space by utilizing the exhaust hot air and water vapor of an electric clothes dryer which comprises a cylinder shaped container having an entrance opening on its side and an exit opening on its top, a flexible conduit having an exit end attached sealingly to and passing through the container entrance opening, the opening of the conduit exit end being directed to the bottom of the container and having an entrance end capable of fitting securely over the exhaust of the clothes dryer, a plurality of wire loops attached to the container traversing the container exit opening and a means for filtering air and water vapor covering the container exit opening, attached to the container and supported by the wire loops.

2. The apparatus of claim 1 where the conduit, container and loops are galvanized steel.

3. The process of heating and humidifying a room by utilizing the exhaust hot gases from an electric clothes dryer by conducting said gases from the dryer into the room through a cylinder shaped container having a volume between about 1 cubic foot and about 5 cubic feet, having an entrance opening on its side and an exit opening on its top, a flexible conduit having an exit end attached sealingly to and passing through the container entrance opening, the opening of the conduit exit end being directed to the bottom of the container and having an entrance attached securely over the exhaust of the dryer, a plurality of wire loops attached to the container traversing the container exit opening and a means for filtering air and water vapor covering the container exit opening, attached to the container and supported by the wire loops, said gases passing through the conduit into the container and out into the room through the filter means.

* * * * *